US008770948B2

(12) United States Patent
Suitou et al.

(10) Patent No.: US 8,770,948 B2
(45) Date of Patent: Jul. 8, 2014

(54) MOTOR-DRIVEN COMPRESSOR

(75) Inventors: Ken Suitou, Kariya (JP); Kazuhiro Kuroki, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 364 days.

(21) Appl. No.: 13/052,295

(22) Filed: Mar. 21, 2011

(65) Prior Publication Data

US 2011/0243763 A1 Oct. 6, 2011

(30) Foreign Application Priority Data

Mar. 31, 2010 (JP) ..... 2010-082920

(51) Int. Cl.

| | |
|---|---|
| ***F04B 35/06*** | (2006.01) |
| ***F04B 35/00*** | (2006.01) |
| ***F04B 35/04*** | (2006.01) |
| ***F01C 21/00*** | (2006.01) |
| ***F04B 39/14*** | (2006.01) |
| ***F04B 39/12*** | (2006.01) |
| ***F04B 39/00*** | (2006.01) |

(52) U.S. Cl.

CPC ..... *F04B 39/0044* (2013.01); *F04C 2270/12* (2013.01); *F04B 35/002* (2013.01); *F04B 35/04* (2013.01); *F01C 21/007* (2013.01); *F04C 2230/604* (2013.01); *F04B 39/14* (2013.01); *F04B 39/127* (2013.01)

USPC ..... 417/363; 417/360

(58) Field of Classification Search

CPC ..... F04B 39/127

USPC ..... 417/360, 363; 267/293

See application file for complete search history.

(56) References Cited

U.S. PATENT DOCUMENTS

| | | | | |
|---|---|---|---|---|
| 4,938,448 | A * | 7/1990 | Shimazaki | 248/635 |
| 6,460,823 | B1 * | 10/2002 | Herder et al. | 248/637 |
| 2001/0032764 | A1 * | 10/2001 | Hasegawa et al. | 188/378 |
| 2002/0131878 | A1 | 9/2002 | Ogawa et al. | |

FOREIGN PATENT DOCUMENTS

| | | | |
|---|---|---|---|
| EP | 1114931 | A2 | 7/2001 |
| JP | 63-65873 | U | 4/1988 |
| JP | 64-44810 | U | 3/1989 |

(Continued)

OTHER PUBLICATIONS

Chinese Office Action with English Translation for Chinese Patent Application No. 201110078488.6 mailed on Jul. 3, 2013.

(Continued)

*Primary Examiner* — Charles Freay
*Assistant Examiner* — Philip Stimpert
(74) *Attorney, Agent, or Firm* — Yoshida & Associates, LLC

(57) ABSTRACT

A motor-driven compressor is to be mounted to a first mounting of a vehicle. The compressor includes a housing having therein a compression mechanism that is electrically powered to draw fluid into the housing for compression and to discharge the compressed fluid out of the housing, and a second mounting for securing the housing to the first mounting. The second mounting includes a first cylindrical member, a damping member made of a resin and provided between the first cylindrical member and the housing, a first fastening member extending through the first cylindrical member and the damping member for securing the first cylindrical member and the damping member to the housing, and a second fastening member inserted through the first cylindrical member for securing the first cylindrical member to the first mounting.

7 Claims, 4 Drawing Sheets

(56) References Cited

FOREIGN PATENT DOCUMENTS

| | | | |
|---|---|---|---|
| JP | 64-44812 | U | 3/1989 |
| JP | 64-44815 | U | 3/1989 |
| JP | 2000-130330 | A | 5/2000 |
| JP | 2004-210062 | A | 7/2004 |
| JP | 2005-220854 | A | 8/2005 |
| JP | 2005-220855 | A | 8/2005 |
| JP | 2005-220856 | A | 8/2005 |
| JP | 2005-255110 | A | 9/2005 |

OTHER PUBLICATIONS

Chinese Office Action with its English translation for Chinese Patent Application No. 201110078488.6 mailed on Jan. 24, 2014.

* cited by examiner

MOTOR-DRIVEN COMPRESSOR

BACKGROUND OF THE INVENTION

The present invention relates to a motor-driven compressor, and more particularly to a motor-driven compressor to be mounted on a vehicle.

Hybrid vehicle that is powered by both engine and electric motor varies the ratio of engine drive to motor drive in accordance with its running condition. In such hybrid vehicle, if a compressor that operates a refrigeration cycle of an air conditioner is driven by the engine of the vehicle, the compressor cannot obtain necessary drive force constantly from the engine. In a hybrid vehicle, therefore, a compressor that is driven by electric power from a battery mounted on the vehicle is used. Such motor-driven compressor is mounted on the body or engine of the vehicle.

The compressor is driven only by the electric motor when the engine is at a stop, such as during an idle stop. When the compressor is driven with the engine at a stop, noise is developed due to the operation of the compressor. Main cause of the noise development is the resonance due to the vibration of the body or engine caused by the vibration of the compressor transmitted via its mounting rather than the sound radiated from the compressor. Various mountings for a motor-driven compressor has been proposed to reduce the vibration transmission from the compressor to the body or engine of the vehicle.

Japanese Unexamined Utility Model Application Publication No. 64-44810 discloses a compressor having cylindrical fittings fixed thereto and used for mounting the compressor to an engine block. Tightening the bolts inserted through the cylindrical fittings into the threaded hole of the engine block, the compressor is mounted to the engine block. A rubber cushion is wrapped around the cylindrical fitting. The cylindrical fitting thus having the rubber cushion wrapped therearound is mounted to the compressor by using a bracket having a curled portion holding therein the cylindrical fitting and screwed to the outer surface of the compressor. The rubber cushion is provided between the bracket and the cylindrical fitting and between the compressor and the cylindrical fitting.

In the compressor disclosed in the publication No. 64-44810 wherein the cylindrical fitting provided on the compressor is held by the bracket screwed to the compressor, however, the cylindrical fitting is not mounted firmly to the compressor because of the rubber cushion provided between the bracket and the cylindrical fitting and the cylindrical fitting and the compressor. This causes displacement of the compressor during operation, so that the compressor vibrates with a large amplitude. The displacement of the compressor may damage the connection between the compressor and the refrigeration circuit. The large-amplitude vibration of the compressor may be transmitted to a vehicle and, therefore, passengers of the vehicle may be subjected to undesired vibration and noise.

The present invention is directed to providing a motor-driven compressor that allows reduction of noise in a vehicle and provides a rigid mounting for the compressor.

SUMMARY OF THE INVENTION

In accordance with an aspect of the present invention, a motor-driven compressor is to be mounted to a first mounting of a vehicle. The compressor includes a housing having therein a compression mechanism that is electrically powered to draw fluid into the housing for compression and to discharge the compressed fluid out of the housing, and a second mounting for securing the housing to the first mounting. The second mounting includes a first cylindrical member, a damping member made of a resin and provided between the first cylindrical member and the housing, a first fastening member extending through the first cylindrical member and the damping member for securing the first cylindrical member and the damping member to the housing, and a second fastening member inserted through the first cylindrical member for securing the first cylindrical member to the first mounting.

Other aspects and advantages of the invention will become apparent from the following description, taken in conjunction with the accompanying drawings, illustrating by way of example the principles of the invention.

DETAILED DESCRIPTION OF THE EMBODIMENTS

The following will describe the embodiments of the motor-driven compressor according to the present invention with reference to the attached drawings. In the embodiments, the compressor is intended to be mounted to an internal combustion engine of a vehicle. It is noted that the upper and lower sides as viewed in FIG. 1 are the upper and lower sides of the compressor, respectively.

Figure 1:
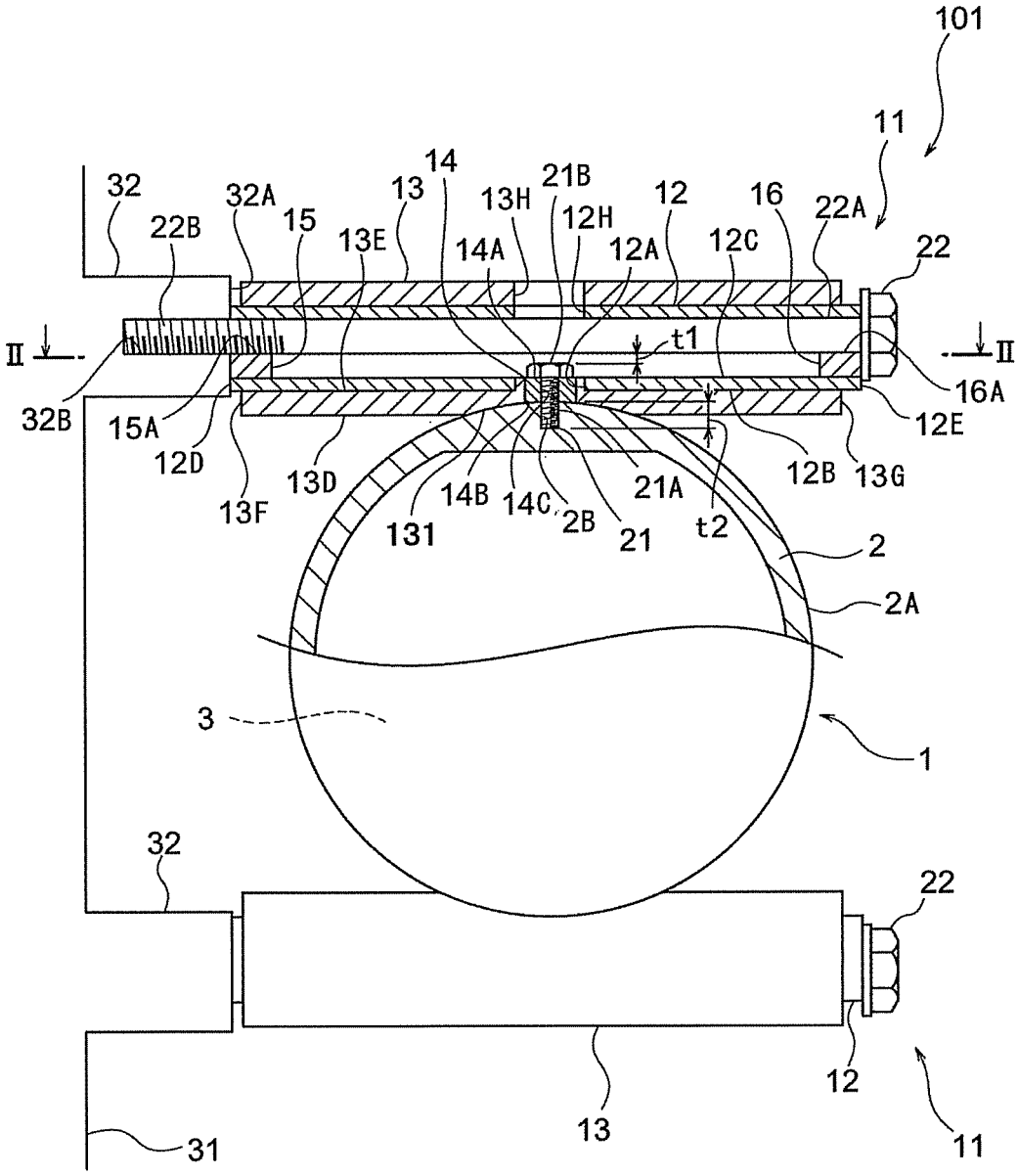
FIG. 1 is a schematic partially cut-away cross-sectional view of a motor-driven compressor according to a first embodiment of the present invention, showing a housing and mountings of the compressor.

Referring to FIG. 1, the motor-driven compressor designated generally by 101 includes a compressor body 1 and plural mountings 11 fixed to the compressor body 1. The compressor body 1 has a cylindrical housing 2 receiving therein a compression mechanism 3 that is electrically powered for compressing fluid such as refrigerant introduced into the housing 2 and discharging the compressed fluid out of the housing 2. The housing 2 is made of a metal such as aluminum alloy.

The mountings 11 (second mounting) are fixed to the upper and lower sides of the outer peripheral surface 2A of the housing 2. Each mounting 11 is of a generally cylindrical shape, the longitudinal axis of which is perpendicular to the longitudinal axis of the housing 2. The mounting 11 includes a cylindrical member 12 and a damping member 13 layered over and around the outer peripheral surface 12B of the cylindrical member 12. The cylindrical member 12 (first cylindrical member) is made of a metal such as aluminum alloy.

The damping member 13 is made of a resin with high adhesion to metal, high rigidity, and high vibration damping property. The material for the damping member 13 has a bending elastic modulus of not less than 100 MPa and not more than 10000 MPa. The material for the damping member 13 includes PP (polypropylene), PBT (polybutylene terephthalate), PVC (polyvinyl chloride), PUR (polyurethane), PTFE (polytetrafluoroethylene), PF (phenol formaldehyde), PC (polycarbonate), PA (polyamide, nylon), ABS (acrylonitrile butadiene styrene), carbon plastic, or composite of such materials. The damping member 13 may be made of any fiber-reinforced plastic (FRP).

The loss factor of the material for the damping member 13, which is associated with vibration damping property, is higher than that of the material for the housing 2 and the cylindrical member 12, preferably ranging from 0.01 to 1. For example, aluminum alloy as a material for the housing 2 and the cylindrical member 12 has a loss factor of about 0.0001. The damping member 13 is formed on the cylindrical member 12 so that the longitudinal ends 13F and 13G of the damping member 13 do not extend beyond the longitudinal ends 12D and 12E of the cylindrical member 12, respectively. The longitudinal length of the damping member 13 is equal to or smaller than that of the cylindrical member 12.

The cylindrical member 12 has at the longitudinal center thereof a hole 12A formed transversely thereof between the outer and inner peripheral surfaces 12B and 12C thereof. The cylindrical member 12 has at a position facing the hole 12A a first mounting hole 12H formed transversely thereof between the outer and inner peripheral surfaces 12B and 12C. The damping member 13 has a second mounting hole 13H formed transversely thereof between the outer and inner peripheral surface 13D and 13E thereof and extending continuously from the first mounting hole 12H of the cylindrical member 12. The first and second mounting holes 12H and 13H cooperate to form a single mounting hole extending between the outer peripheral surface 13D of the damping member 13 and the inner peripheral surface 12C of the cylindrical member 12.

Figure 2:
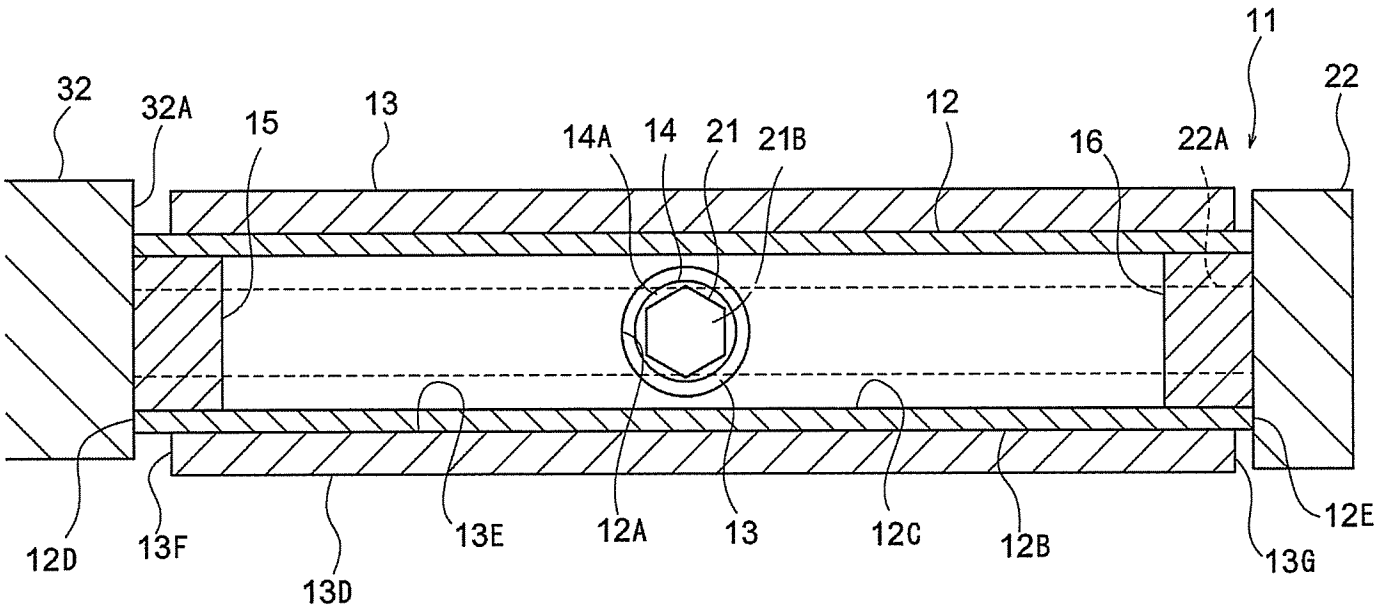
FIG. 2 is a cross-sectional view taken along the line II-II of FIG. 1.

Referring to FIG. 2, there is provided in the hole 12A an annular collar 14 the outer diameter of which is smaller than the diameter of the hole 12A. The collar 14 (second cylindrical member) extends between the inner peripheral surface 12C of the cylindrical member 12 and the outer peripheral surface 13D of the damping member 13 and has a hole 14C formed therethrough between the opposite end surfaces 14A and 14B thereof. As with the cylindrical member 12, the collar 14 is made of a metal such as aluminum alloy. The damping member 13 fills between the cylindrical member 12 and the collar 14 in the hole 12A so as to surround the collar 14. Thus, the damping member 13 keeps the collar 14 from coming into direct contact with the cylindrical member 12. The damping member 13 is formed integrally with the cylindrical member 12 and the collar 14, for example, by insert molding.

As shown in FIG. 1, the outer peripheral surface 13D of the damping member 13 has an inwardly curved mounting surface 131 the profile of which corresponds to the profile of the outer peripheral surface 2A of the housing 2. Part of the damping member 13 adjacent to the mounting surface 131 thereof covers the outer peripheral surface 12B of the cylindrical member 12 and, therefore, the cylindrical member 12 is not exposed to the mounting surface 131. The end surface 14B of the collar 14 is exposed to the mounting surface 131 and has a profile corresponding to the profile of the outer peripheral surface 2A of the housing 2. The housing 2 has in the outer peripheral surface 2A thereof an internally threaded hole 2B extending radially inward of the housing 2.

In mounting the cylindrical member 12 and the damping member 13 to the housing 2, firstly, the mounting surface 131 of the damping member 13 and the end surface 14B of the collar 14 are set in contact with the outer peripheral surface 2A of the housing 2 so that the collar 14 is positioned in facing relation to the threaded hole 2B of the housing 2. Next, a fastener 21 (first fastening member) such as screw having an externally threaded shaft 21A is inserted into the cylindrical member 12 through the second mounting hole 13H of the damping member 13 and the first mounting holes 12H of the cylindrical member 12. The shaft 21A of the fastener 21 is further inserted through the hole 14C of the collar 14 and screwed into the threaded hole 2B of the housing 2. Tightening the fastener 21 using a tool (not shown) inserted into the cylindrical member 12 through the first and second mounting holes 12H and 13H, the collar 14 is fastened to the housing 2. In this way, the cylindrical member 12 and the damping member 13 which are integrated with the collar 14 are mounted to the housing 2 by the fastener 21. The fastener 21 is made of a metal.

With the cylindrical member 12 and the damping member 13 thus mounted to the housing 2, the damping member 13 is provided between the cylindrical member 12 and the housing 2, which keeps the cylindrical member 12 from coming into contact with the housing 2. The collar 14 surrounding the shaft 21A of the fastener 21 is surrounded by the damping member 13 and, therefore, neither the fastener 21 nor the collar 14 is in contact with the cylindrical member 12. Since the diameter of the head 21B of the fastener 21 is smaller than the outer diameter of the collar 14 (see FIG. 2), the fastener 21 is in contact with neither the cylindrical member 12 nor the damping member 13, but in contact only with the collar 14. Compressive force due to tightening the fastener 21 is supported by the collar 14 that is in contact with the fastener 21 and the outer peripheral surface 2A of the housing 2. The cylindrical member 12 made of a metal is neither in direct contact with the housing 2 nor coupled to the housing 2 only through a metallic member. The cylindrical member 12 is coupled to the housing 2 through the damping member 13.

The mounting 11 further includes a first bush 15 and a second bush 16 provided at the opposite ends of the cylindrical member 12. The first and second bushes 15 and 16 are of a cylindrical shape and fitted in the inner peripheral surface 12C of the cylindrical member 12. The first bush 15 has a hole 15A the axis of which is eccentric to the axis of the cylindrical member 12; and similarly the second bush 16 has a hole 16A the axis of which is eccentric to that of the cylindrical member 12. The axes of the holes 15A and 16A are eccentric in the direction toward the part of the inner peripheral surface 12C facing the fastener 21, that is, in upward direction in FIG. 1.

An engine 31, to which the compressor 101 is mounted, has cylindrical mountings 32. The mounting 32 (first mounting) has in the end surface 32A thereof an internally threaded hole 32B extending along the axis of the mounting 32.

In mounting the compressor 101 to the engine 31, the mountings 11 of the compressor 101 are secured to the respective mountings 32 of the engine 31. Firstly, with the end 12D of the cylindrical member 12 of the mounting 11 set in contact with the end surface 32A of the mounting 32, a fastener 22 (second fastening member) having a shaft 22A formed with an external thread 22B is inserted through the cylindrical member 12 from the hole 16A of the second bush 16 and further through the hole 15A of the first bush 15. Then the shaft 22A is screwed into the threaded hole 32B of the mounting 32, so that the cylindrical member 12 is fastened to the mounting 32 by the fastener 22. In this way, the mounting 11 is secured to the mounting 32. The fastener 22 is made of a metal.

With the mounting 11 of the compressor 101 thus secured to the mounting 32 of the engine 31, the opposite ends 12D and 12E of the cylindrical member 12 are in contact with the end surface 32A of the mounting 32 and the fastener 22, respectively. Compressive force due to tightening the fastener 22 is supported by the cylindrical member 12, and the damping member 13 is not subjected to such compressive force. Although the shaft 22A of the fastener 22 is located facing the head 21B of the fastener 21, the axes of the holes 15A and 16A through which the shaft 22A is inserted are eccentric to the axis of the cylindrical member 12, so that a clearance t1 is formed between the head 21B of the fastener 21 and the shaft 22A of the fastener 22, thus keeping the shaft 22A from coming into contact with the fastener 21.

While the compressor 101 is in operation, the compression mechanism 3 is operated in the housing 2 thereby to cause vibration of the housing 2. Most of the vibration is transmitted directly to the damping member 13 through the mounting surface 131 that is in contact with the housing 2. The rest of the vibration is transmitted through the fastener 21 and the collar 14 to the damping member 13 located around the collar 14. In this way, all of the vibration of the housing 2 is transmitted to the damping member 13.

Vibration transmitted from the housing 2 to the damping member 13 is dampened because of high loss factor of the damping member 13, which prevents the vibration of the housing 2 from being transmitted to the metal cylindrical member 12. Thus, the vibration of the housing 2 is prevented from being transmitted to the engine 31, resulting in reduced vibration transmission to a vehicle body (not shown) where the engine 31 is mounted. Further, the damping member 13 which is made of a resin material having a bending elastic modulus ranging from 100 to 10000 MPa has high rigidity and, therefore, the vibration of the housing 2 causes no deformation of the damping member 13. This prevents displacement of the housing 2 relative to the mounting 11 thereby to prevent the housing 2 from vibrating with a large amplitude.

As described above, the compressor 101 has the mounting 11 by which the housing 2 is fixed to the mounting 32 of the engine 31. The housing 2 has therein the compression mechanism 3 that is electrically powered to draw fluid into the housing 2 for compression and to discharge the compressed fluid out of the housing 2. The mounting 11 includes the cylindrical member 12 fixed to the housing 2 and the damping member 13 made of a resin and provided between the cylindrical member 12 and the housing 2. The cylindrical member 12 and the damping member 13 are fastened to the housing 2 by the fastener 21 extending through the cylindrical member 12 and the damping member 13. The cylindrical member 12 is fastened to the mounting 32 by the fastener 22 inserted through the cylindrical member 12. The fastener 22 extends longitudinally of the cylindrical member 12, and the fastener 21 extends transversely of the cylindrical member 12.

All of the vibration of the housing 2 is transmitted to the damping member 13 between the cylindrical member 12 and the housing 2 and dampened there because of the resin material of high vibration damping property. This results in reduced vibration transmission from the compressor 101 through the engine 31 to a vehicle body (not shown), thereby allowing reduction of resonance noise in a vehicle. Further, the cylindrical member 12 and the damping member 13 which are fastened to the housing 2 by the fastener 21 inserted through the cylindrical member 12 and the damping member 13 are firmly mounted to the housing 2.

Since the material of the damping member 13 has a higher vibration damping property than that of the housing 2, the vibration transmitted from the housing 2 to the damping member 13 is efficiently dampened.

Since compressive force of the fastener 22 is supported by the metal cylindrical member 12 provided between the mounting 32 and the fastener 22, the damping member 13 is subjected to no such compressive force. This allows the fastener 22 to be tightened securely, so that the cylindrical member 12 is firmly mounted to the mounting 32, and also reduces fatigue and creep occurring in the damping member 13 thereby to prevent the damping member 13 from being separated from the cylindrical member 12.

The metal collar 14 through which the fastener 21 is inserted is provided between the fastener 21 and housing 2, and the damping member 13 is provided between the collar 14 and the cylindrical member 12. Since the compressive force of the fastener 21 is supported by the collar 14, the damping member 13 is subjected to no such compressive force. This allows the fastener 21 to be tightened securely, so that the cylindrical member 12 and the damping member 13 are firmly mounted to the housing 2, and also reduces fatigue and creep occurring in the damping member 13. Further, the provision of the damping member 13 between the collar 14 and the cylindrical member 12 prevents the vibration transmission from the housing 2 through the fastener 21 and the collar 14 to the cylindrical member 12.

The damping member 13 is made of a resin having a bending elastic modulus of not less than 100 MPa and not more than 10000 MPa, which provides, the damping member 13 with high rigidity and prevents displacement of the housing 2 caused by vibration. The fastener 21 is arranged so that its head 21B is located within the cylindrical member 12 without projecting. This leads to a reduction of the space occupied by the compressor 101.

Although the fastener 21 of the previous embodiment is made of a metal, it may be made of a resin. In this case, the metal cylindrical member 12 may be in contact with the fastener where vibration transmitted from the housing 2 can be dampened. Further, the collar 14 need not to be provided, resulting in a reduced manufacturing cost.

In the previous embodiment, the metal cylindrical member 12 supports the compressive force of the fastener 22. Alternatively, the cylindrical member 12 and the damping member 13 may be replaced by a single resin member having a higher loss factor than the housing 2 and also a strength that is enough to support the compressive force of the fastener 22. In this case, the cylindrical member 12 and the collar 14 need not to be provided, resulting in a reduced manufacturing cost.

Although in the previous embodiment the damping member 13 is formed around the outer peripheral surface 12B of the cylindrical member 12, the damping member 13 only need to be formed on the part of the cylindrical member 12 which is adjacent to the housing 2.

Figure 3:
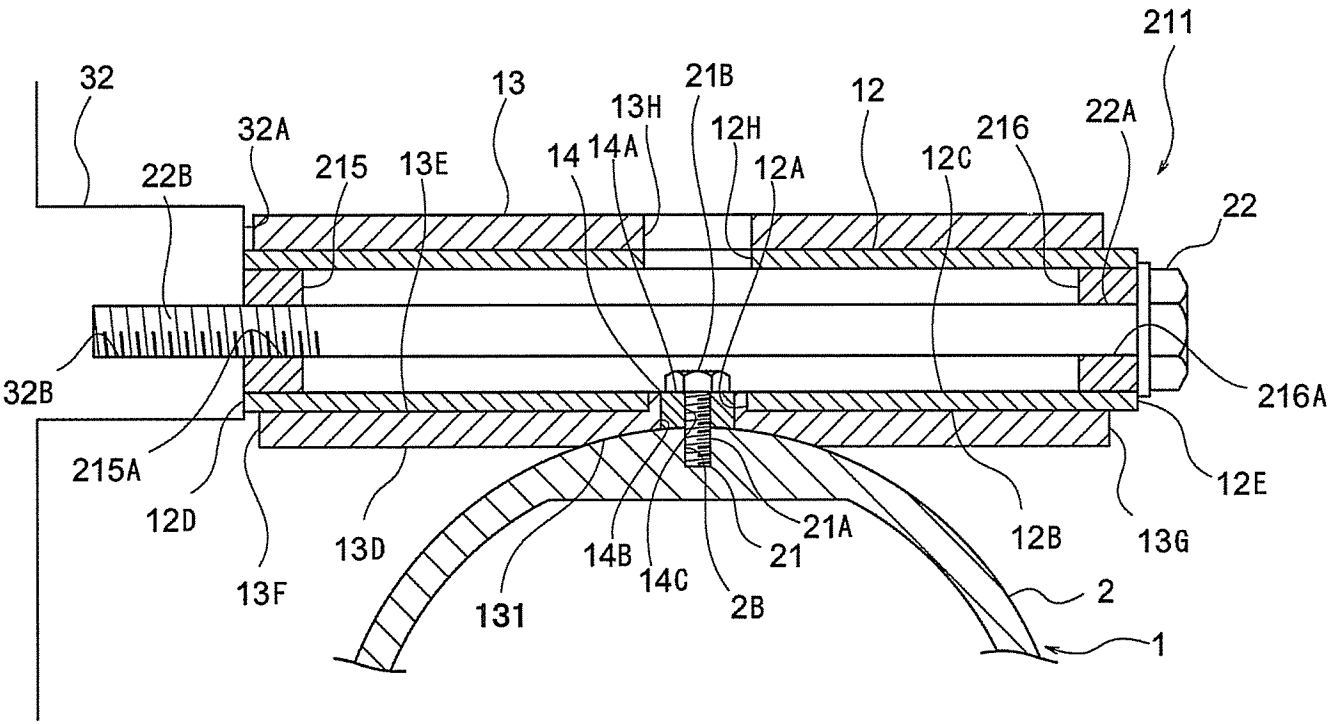
FIG. 3 is a fragmentary partially cross-sectional view, showing another embodiment of the mounting of the compressor.
Figure 4:
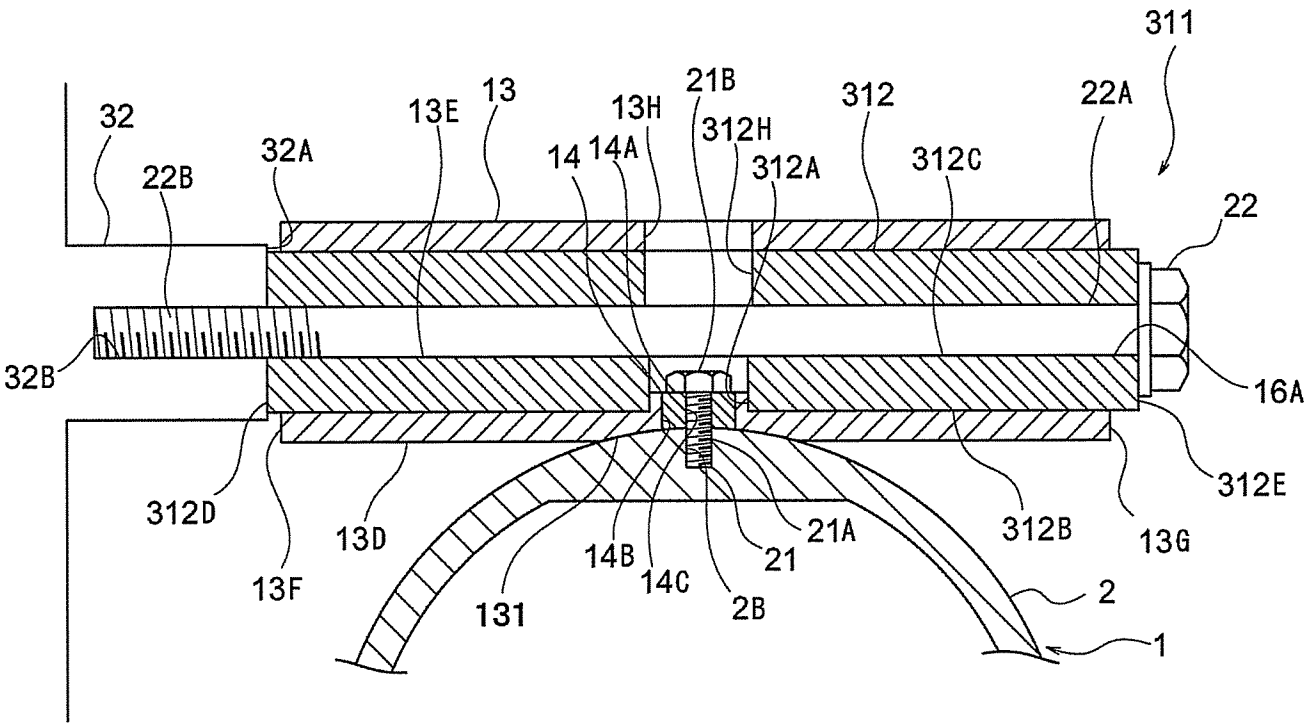
FIG. 4 is similar to FIG. 3, but showing still another embodiment of the mounting of the compressor.

In the previous embodiment, the axes of the holes 15A and 16A of the first and second bushes 15 and 16 are eccentric to the axis of the cylindrical member 12 in the direction toward the part of the inner peripheral surface 12C of the cylindrical member 12 facing the fastener 21. With the mounting 11 of the compressor body 1 secured to the mounting 32 of the vehicle, there only need to be a clearance between the head 21B of the fastener 21 and the shaft 22A of the fastener 22 so as to prevent contact between the fasteners 21 and 22. Specifically, as shown in FIG. 3, it may be so arranged that the axes of the holes 215A and 216A of the bushes 215 and 216 of the mounting 211 (second mounting) are concentric with the axis of the cylindrical member 12 and the head 21B of the fastener 21 is located radially outward of the holes 215A and 216A of the bushes 215 and 216. Alternatively, as shown in FIG. 4, it may be so arranged that the mounting 311 (second mounting) has no bush such as 15, 16, 215, 216 as in the case of FIGS. 1 through 3 and the head 21B of the fastener 21 is located radially outward of the inner peripheral surface 312C of the cylindrical member 312 (first cylindrical member).

Referring to FIG. 1, it may be so arranged that the clearance t1 between the head 21B of the fastener 21 and the shaft 22A of the fastener 22 is smaller than the length t2 for which the fastener 21 is screwed into the threaded hole 2B. In this case, if the fastener 21 is loosened slightly due to the use over the years, the head 21B of the fastener 21 comes into contact with the shaft 22A of the fastener 22, which prevents the fastener 21 from being removed from the threaded hole 2B. Further, the compressor body 1 is held on the opposite upper and lower sides thereof by the mountings 11 which are fixed to the mountings 32 of the engine 31. Thus, if the fastener 21 is loosened slightly, the compressor body 1 is hardly moved relative to the mountings 11 and prevented from being removed from the mountings 11.

Although in the previous embodiments the mountings 11, 211 and 311 are provided for the motor-driven compressor 101 mounted to the engine 31, such mountings may be provided for a motor-driven compressor to be mounted to an electric traction motor in a fuel cell vehicle or electric vehicle. The present invention may be applied not only to a refrigerant compressor for a refrigeration circuit but also to other motor-driven compressors such as an air compressor for a vehicle air suspension system or a pump for delivering hydrogen or air to a stack in a fuel cell vehicle.

What is claimed is:

1. A motor-driven compressor to be mounted to a first mounting of a vehicle, comprising:

a housing having therein a compression mechanism that is electrically powered to draw fluid into the housing for compression and to discharge the compressed fluid out of the housing; and a second mounting for securing the housing to the first mounting, the second mounting comprising a first cylindrical member;

a damping member made of a resin and provided between the first cylindrical member and the housing;

a first fastening member extending through the first cylindrical member and the damping member for securing the first cylindrical member and the damping member to the housing; and a second fastening member inserted through the first cylindrical member for securing the first cylindrical member to the first mounting, wherein the second fastening member has a longitudinal axis that intersects a longitudinal axis of the first fastening member.

2. The motor-driven compressor according to claim 1, wherein vibration damping property of the material of the damping member is higher than that of a material of the housing.

3. The motor-driven compressor according to claim 1, wherein the first fastening member is a screw having a head that is located within the first cylindrical member.

4. The motor-driven compressor according to claim 1, wherein the longitudinal length of the damping member is equal to or smaller than that of the first cylindrical member.

5. The motor-driven compressor according to claim 1, wherein the first cylindrical member is made of a metal, the first cylindrical member between the first mounting and the second fastening member serves to support compressive force that is due to tightening of the second fastening member.

6. The motor-driven compressor according to claim 1, wherein the second mounting further comprises a second cylindrical member made of a metal and provided between the first fastening member and the housing, the first fastening member is inserted through the second cylindrical member, the damping member is provided between the first cylindrical member and the second cylindrical member.

7. The motor-driven compressor according to claim 1, the material of the damping member has a bending elastic modulus of not less than 100 MPa and not more than 10000 MPa.

* * * * *